United States Patent [19]

Dossche

[11] Patent Number: 4,824,142

[45] Date of Patent: Apr. 25, 1989

[54] CONTINUOUS BUSINESS FORMS

[75] Inventor: Bernard Dossche, Mariakerke, Belgium

[73] Assignee: Moore Business Forms, Inc., Glenview, Ill.

[21] Appl. No.: 91,344

[22] Filed: Aug. 31, 1987

Related U.S. Application Data

[63] Continuation of Ser. No. 914,085, Oct. 1, 1986, abandoned.

[30] Foreign Application Priority Data

Oct. 3, 1985 [GB] United Kingdom ..... 8524389

[51] Int. Cl.[4] ..... B41L 1/26

[52] U.S. Cl. ..... 282/11.5 A; 229/69; 229/1.5 R; 282/25; 283/901; 283/116

[58] Field of Search ..... 229/1.5 R, 68 R, 69; 282/1 R, 8 R, 9 R, 11.5 R, 11.5 A, 12 R, 12 A, 25; 283/1 B, 61, 72, 901

[56] References Cited

U.S. PATENT DOCUMENTS

| | | | |
|---|---|---|---|
| 1,198,326 | 9/1916 | Carey | 282/12 A |
| 2,396,221 | 3/1946 | Yancey | 283/1 |
| 2,669,464 | 2/1954 | Lay et al. | 282/25 |
| 3,075,791 | 1/1963 | Wolf | 282/1 |
| 3,261,623 | 7/1966 | Kiedrowski | 282/25 |
| 4,190,268 | 2/1980 | Webster | 282/3 R |
| 4,632,427 | 12/1986 | Angus | 229/69 X |

*Primary Examiner*—Paul A. Bell

*Attorney, Agent, or Firm*—Cushman, Darby & Cushman

[57] ABSTRACT

This invention is concerned with a continuous assembly of self mailer web parts secured together by heat seal adhesive in which a part of the assembly to receive a personal identification number has attached to it a patch of self copy paper with the sensitive coating side of the self copy paper towards the form assembly and other other side of the patch bearing masking printing.

24 Claims, 4 Drawing Sheets

1
2
3
4
5
6
7
8
9
10
11
12
13
14
17

18
5
4
2
17
10
12
6
11
19
20
21
30
3

CONTINUOUS BUSINESS FORMS

This is a continuation of application Ser. No. 914,085, filed Oct. 1, 1986, which was abandoned upon the filing hereof.

This invention has reference to continuous business forms assemblies which are subsequently processed to become a self mailer piece and has particular reference to continuous business forms assemblies comprising a plurality of individual business forms in continuous format and each being capable of recording a personal identification number often referred to as PIN number at a predetermined position on the form. Personal identification numbers are numbers given by banks to their customers and more especially to customers who wish to withdraw money from a bank cash dispenser. In such dispensers it is the practice for customers who wish to draw cash from the dispenser to insert a cash card into the machine and then to key a code number into the dispenser keyboard. If the number keyed corresponds to the number recorded on the cash card (as on a magnetic tape on the card but not printed or embossed on the cash card and capable of being visually read) the dispenser issues the cash (usually in the form of bank notes) being the amount requested.

It is required that the personal identification number be known only to the holder of the card but to no third party. In particular the form is required to be such that on inspection the personal identification number cannot be related to a particular individual.

In the field of business forms assemblies it is known to use business forms as a continuous assembly capable of being processed to form a plurality of self mailer pieces which assembly is in two parts either as a single web folded longitudinally at about its longitudinal center line or as two separate continuous web parts collated together and provided with heat seal adhesive so that when the collated forms construction is passed through a heat seal mechanism and divided into mailer lengths the two parts form a simple self mailer piece. One example of such an assembly is described in the Specification of British Pat. No. 1249054; other examples are described in British Specification No. 1564423. Another example is described in the Specification of European Patent Application No. 0143622.

It is an object of the present invention to provide an improved continuous envelope assembly in which a user's personal identification number may be selectively printed at a predetermined position on the business form in such a way that the identification number appears only to the recipient. According to the present invention a business form assembly comprises a continuous assembly of self mailer web parts in the form either of a single web folded longitudinally into two web parts or of two separate web parts collated together and having heat seal adhesive 7,8 to secure the web parts together characterized in that the part 11 of the assembly to receive a personal identification number has attached to it a patch 12 of self copy paper with the sensitive coating side of the self copy paper towards the forms assembly and the other side of the patch bearing masking printing.

Conveniently a separate web of transfer material paper conveniently of carbon paper is temporarily attached to the part of the form to receive the printed copy data.

A business forms assembly in accordance with the present invention will now be described by way of example with reference to the accompanying drawings wherein.

Figure 1:
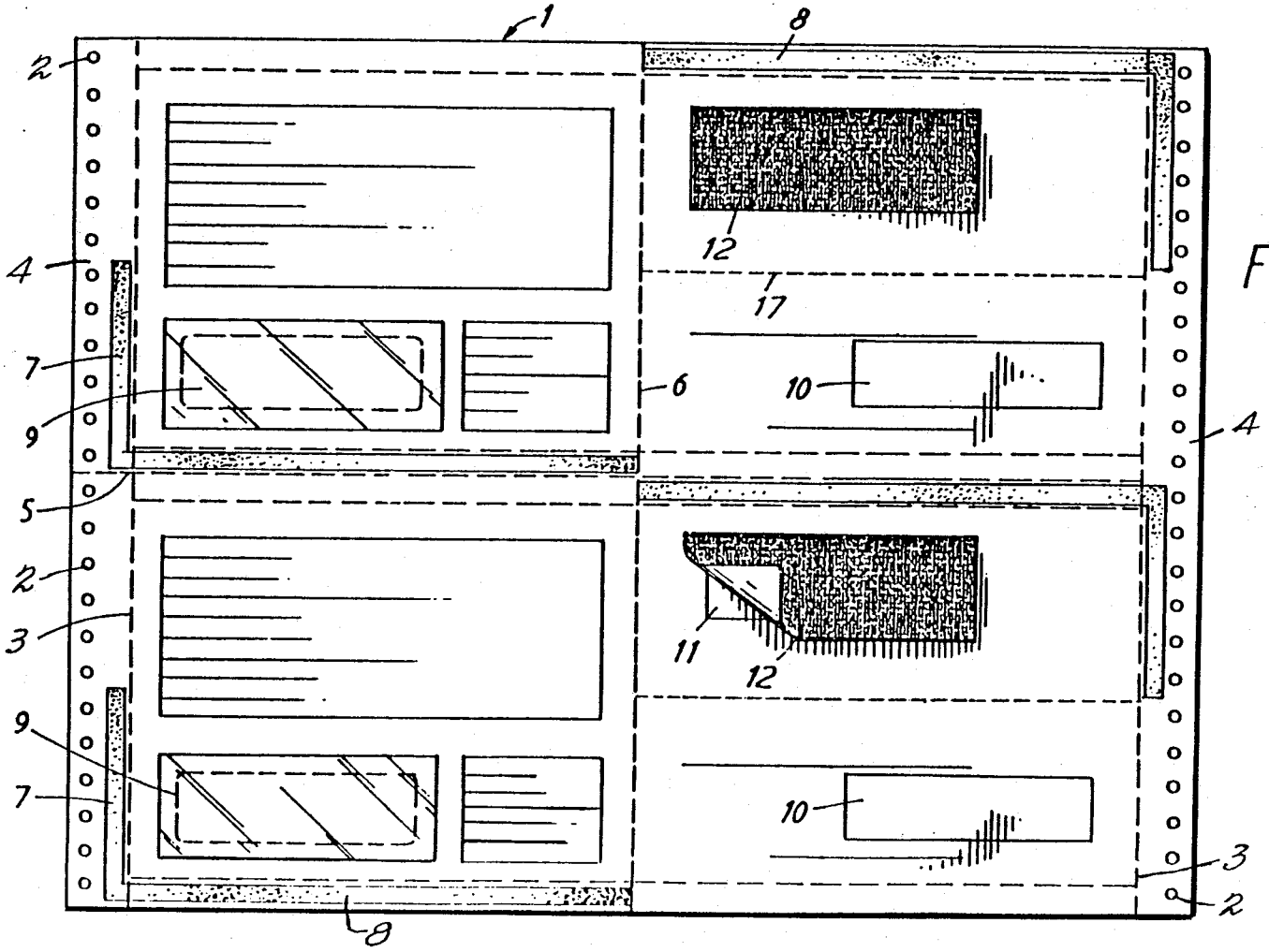
FIG. 1 is a view of the assembly to be folded and heat sealed.

The business forms assembly as shown in FIG. 1 which is to be processed and become a self mailer piece comprises a business forms web 1 with marginal feed aperture 2 with lines of longitudinal tear off perforations 3 to define feed margins 4 at the edge of each web. The web is also provided with transverse perforations 5 to divide the web into envelope lengths. A longitudinal line of perforations 6 is provided centrally of the web 1 and serves as a center fold line about which the two parts of the web are folded. The left hand side of the web (as shown on the drawings) is provided with areas of heat seal adhesive 7 and the right hand side of the web (as shown in the drawings) is provided with complementary areas of heat seal adhesive 8 on each envelope length. These areas of heat seal adhesive when the two parts of the web are folded about the center line of perforations 6 and passed through a heat sealer equipment secure the two parts together to form a self mailer piece.

One part of each form length is provided with a patch window 9 and this is arranged to overlie the address receiving part 10 of the envelope length where the name and address of the person to whom the envelope is to be sent are printed. An area 11 of each envelope web is arranged to receive a customer's personal identification number and this area 11 has a masking patch 12 applied to cover it. The patch 12 comprises a sheet of paper coated on one side with a CB (coated back) coating and on the other side with masking to hide any chance of the personal identification number being revealed as by looking at the form held up to the light. The area 11 of each envelope web is coated with a CF (coated front) coating to coact with the CB coating on the patch 12 to produce a reproduction of the PIN number of the underface of the part of the form assembly covered by the patch 12. Other parts of the internal faces of the form assembly are provided with areas to receive printed data about the name and address of the recipient together with any other information about the transaction being recorded as may be required. In order to keep the personal identification number separate from the address on the forms assembly a transverse line of perforations 17 is provided between the area 11 to receive the PIN number and the area 10 to receive the name and address of the customer. This is to enable details of the PIN number to be removed from the forms assembly but to keep the sheets of the assembly otherwise secured together by detaching and removing the part of the form containing the PIN number.

In use of the assembly as described printing is effected using a carbon ribbon (not shown) but which is included on a typewriter or line printer on which information is applied to the forms assembly in which case the personal identification number is printed on the back of the patch and is hidden by virtue of the masking printing. When the form assembly is in use the assembly is fed through a print unit to have the data applied to the assembly, the information is printed on the carbon ribbon and the other information is reproduced at those parts of the web underlying the carbon ribbon and is also reproduced beneath the copy material patch.

The continuous web is folded longitudinally about the line 6 and is detached into form lengths and then passed through a heat seal machine and the heat sealed mailer pieces so formed are then posted to recipients. The recipient then detaches the margins by tearing off along the perforation line 17 to detach the part of the form containing the PIN number and by tearing off along the perforation lines to reveal the information printed on the inside of the assembly. The personal identification number is revealed by removing the patch.

Figure 2:
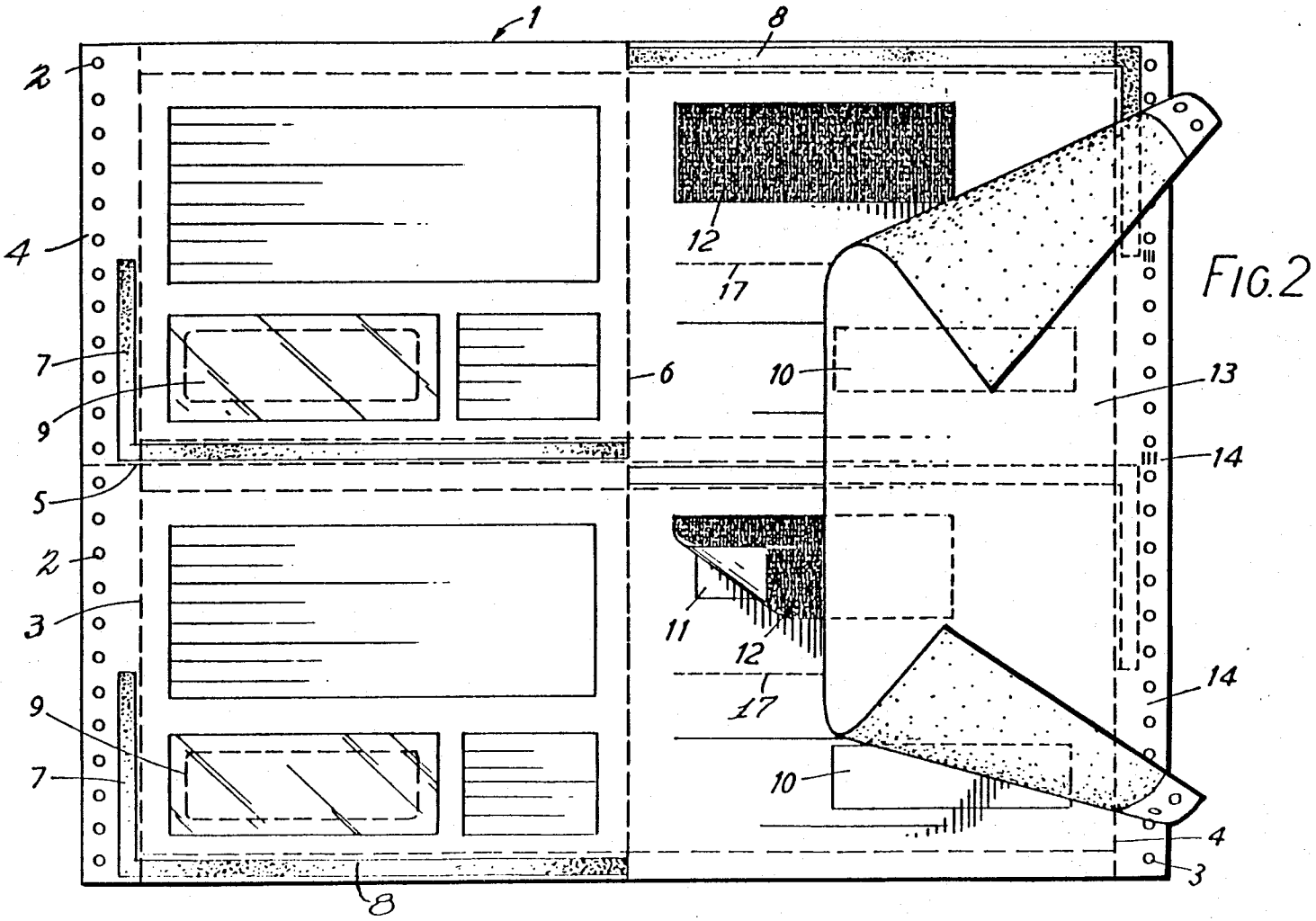
FIG. 2 is a view of another assembly.

In a first modified form of the invention as shown in FIG. 2 a web 13 of carbon paper is secured to the envelope assembly web 1 as by paper staples 14 to enable typed information or data to be applied to the form. When printing is effected as in a typewriter or print out this is effected without a carbon ribbon.

Figure 3:
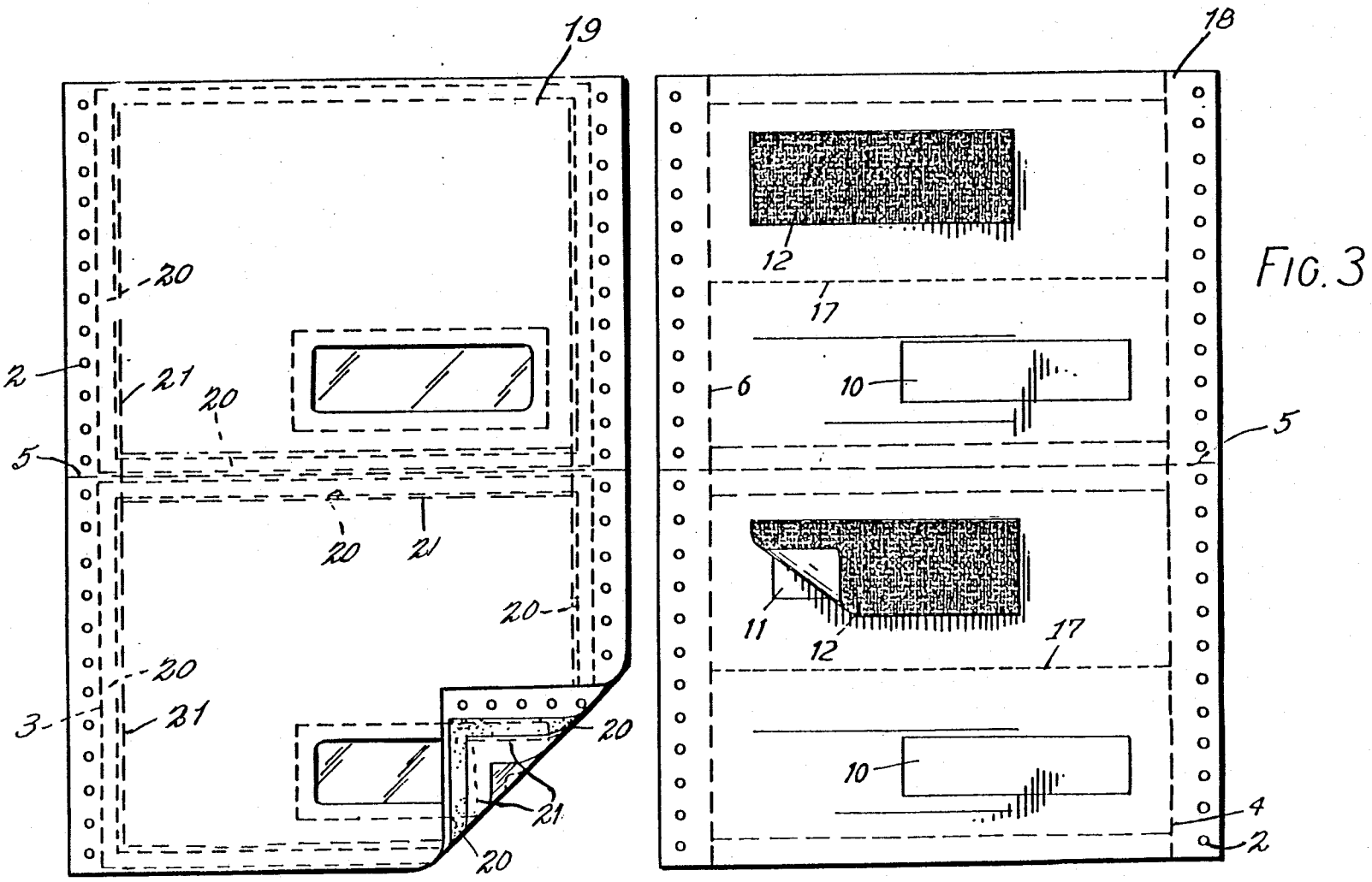
FIG. 3 is a similar view of a further assembly comprising two separate webs.

In a modified form of the invention as shown in FIG. 3 the business forms assembly comprises two separate webs 18,19 similar to those more fully described in the specification of European Patent Application No. 0143622. The web 18 bears printed information or data which includes as shown areas 10 to receive the address of the person to whom the envelope is to be sent. The web also includes an area 11 to receive a personal identification number which is covered with a masking patch 12. The area 11 of each envelope web is coated with a CF (coated front) coating to coact with the CB coating on the underside of the patch 12. The top side of the patch bears masking. A line of cross perforations 5 divides the web into form lengths and another line of cross perforations 17 divides the area of the web bearing the person identification number from the address area 10. The web 18 bears no heat seal adhesive but the web 19 bears the lines 20 of heat seal adhesive around the periphery of each form length of the web.

The two webs 18,19 are collated and submitted to the action of heat to act on the heat seal lines 20 to heat seal the two webs together. The heat sealed web is then subjected to a bursting operation to divide the web into envelope lengths and further processed as described in connection with the embodiment shown in FIG. 1.

Figure 4:
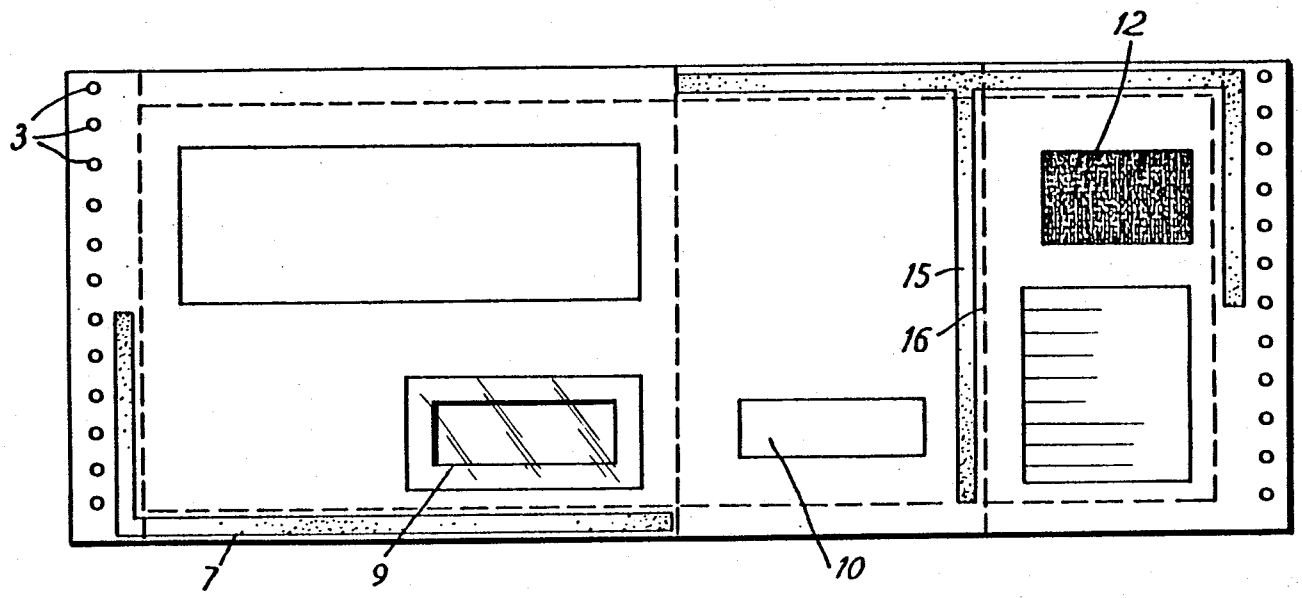
FIG. 4 is a view of a modified assembly similar to FIG. 1.

In a further modified form of the invention as shown in FIG. 4 the positions of the address receiving part 10 and the area 12 to receive the personal identification number are separated by a further line of adhesive 15 (similar to the line of adhesive 7). This line of adhesive 15 extends longitudinally of the continuous assembly from the line of adhesive so as to be overlapped by the line of adhesive 7 of the other part of the assembly. A line of tear off perforations 16 is provided adjacent to and parallel to the line of adhesive 15 on the side adjacent to the area 12. This line of tear off perforations is arranged so that the single part of the assembly when eventually delivered to the customer may be separated so that the name of the customer is on one separated part and the personal identification number is on the other separated part.

Inasmuch as other embodiments of the invention will be apparent upon reading the foregoing specification the scope of the invention is to be determined from the appended claims.

What is claimed is:

1. A business forms assembly comprising a continuous assembly of self mailer web parts in the form of a single web folded longitudinally into two web parts or of two separate web parts collated together and having heat sealed adhesive to secure the web parts together characterized in that the part of the assembly to receive a personal identification number has attached to it a patch of self copy paper with the sensitive coating side of the self copy paper towards the forms assembly and the other side of the patch bearing masking printing.

2. A business forms assembly according to claim 1 wherein a longitudinal line of adhesive and a longitudinal line of perforations separates the part to receive the personal identification marker from the area to which the name and address of the customer is applied.

3. A business forms assembly according to claim 1 wherein a separate web of transfer material paper is temporarily attached to the part of the form to receive the printed copy data.

4. A business forms assembly according to claim 3 wherein a longitudinal line of adhesive and a longitudinal line of perforations separates the part to receive the personal identification marker from the area to which the name and address of the customer is applied.

5. A business forms assembly according to claim 1 characterized in that one of the web parts bears one area of heat seal adhesive and the other of the web parts bears another area of adhesive.

6. A business forms assembly according to claim 5 characterized in that the area of the assembly to receive a personal identification number has longitudinal tear off perforations with an adjacent line of adhesive on the side of the line of tear off perforations away from the area to receive the personal identification number.

7. A business forms assembly according to claim 6 wherein a longitudinal line of adhesive and a longitudinal line of perforations separates the part to receive the personal identification marker from the area to which the name and address of the customer is applied.

8. A business forms assembly according to claim 6 wherein a separate web of transfer material paper is temporarily attached to the part of the form to receive the printed copy data.

9. A business forms assembly according to claim 8 wherein a longitudinal line of adhesive and a longitudinal line of perforations separates the part to receive the personal identification marker from the area to which the name and address of the customer is applied.

10. A business forms assembly according to claim 5 wherein a separate web of transfer material paper is temporarily attached to the part of the form to receive the printed copy data.

11. A business forms assembly according to claim 10 wherein a longitudinal line of adhesive and a longitudinal line of perforations separates the part to receive the personal identification marker from the area to which the name and address of the customer is applied.

12. A business forms assembly according to claim 5 wherein a longitudinal line of adhesive and a longitudinal line of perforations separates the part to receive the personal identification marker from the area to which the name and address of the customer is applied.

13. A business forms assembly according to claims 1 or 5 wherein the patch bears a coated front coating and the complementary area of the forms assembly bears a coated back coating.

14. A business forms assembly according to claim 13 characterized in that the area of the assembly to receive a personal identification number has longitudinal tear off perforations with an adjacent line of adhesive on the side of the line of tear off perforations away from the area to receive the personal identification number.

15. A business forms assembly according to claim 14 wherein a separate web of transfer material paper is temporarily attached to the part of the form to receive the printed copy data.

16. A business forms assembly according to claim 15 wherein a longitudinal line of adhesive and a longitudinal line of perforations separates the part to receive the personal identification marker from the area to which the name and address of the customer is applied.

17. A business forms assembly according to claim 14 wherein a longitudinal line of adhesive and a longitudinal line of perforations separates the part to receive the personal identification marker from the area to which the name and address of the customer is applied.

18. A business forms assembly according to claim 13 wherein a separate web of transfer material paper is temporarily attached to the part of the form to receive the printed copy data.

19. A business forms assembly according to claim 18 wherein a longitudinal line of adhesive and a longitudinal line of perforations separates the part to receive the personal identification marker from the area to which the name and address of the customer is applied.

20. A business forms assembly according to claim 13 wherein a longitudinal line of adhesive and a longitudinal line of perforations separates the part to receive the personal identification marker from the area to which the name and address of the customer is applied.

21. A business forms assembly according to claim 1 characterized in that the area of the assembly to receive a personal identification number has longitudinal tear off perforations with an adjacent line of adhesive on the side of the line of tear off perforations away from the area to receive the personal identification number.

22. A business forms assembly according to claim 21 wherein a separate web of transfer material paper is temporarily attached to the part of the form to receive the printed copy data.

23. A business forms assembly according to claim 22 wherein a longitudinal line of adhesive and a longitudinal line of perforations separates the part to receive the personal identification marker from the area to which the name and address of the customer is applied.

24. A business forms assembly according to claim 21 wherein a longitudinal line of adhesive and a longitudinal line of perforations separates the part to receive the personal identification marker from the area to which the name and address of the customer is applied.

* * * * *